United States Patent [19]

De Rosa

[11] 4,008,382

[45] Feb. 15, 1977

[54] SAFETY ELECTRICAL PLUG

[75] Inventor: Richard P. De Rosa, Bound Brook, N.J.

[73] Assignee: The Raymond Lee Organization, Inc., New York, N.Y. ; a part interest

[22] Filed: Mar. 10, 1975

[21] Appl. No.: 556,843

[52] U.S. Cl. ..... 200/51 R; 200/51.07

[51] Int. Cl.[2] ..... H01R 13/70

[58] Field of Search ..... 200/51 R, 51.07, 51.12

[56] References Cited

UNITED STATES PATENTS

| | | | |
|---|---|---|---|
| 1,399,120 | 12/1921 | Howard | 200/51.12 |
| 1,615,245 | 1/1927 | Strauch | 200/51.12 |
| 1,760,138 | 5/1930 | Hunt | 200/51.07 |
| 1,912,252 | 5/1930 | Brown | 200/51.07 |

*Primary Examiner*—David Smith, Jr.
*Attorney, Agent, or Firm*—Howard I. Podell

[57] ABSTRACT

An electrical plug adaptable for joining the conductors of an attached line cord to a socket, in which conducting elements are mounted on one or more discs rotatably mounted in the plug so that the plug conducts electricity only when the discs are rotated to a particular setting. The plug prevents unauthorized use, particularly by young children, when the discs are rotated off the particular setting.

2 Claims, 3 Drawing Figures

FIG. 1
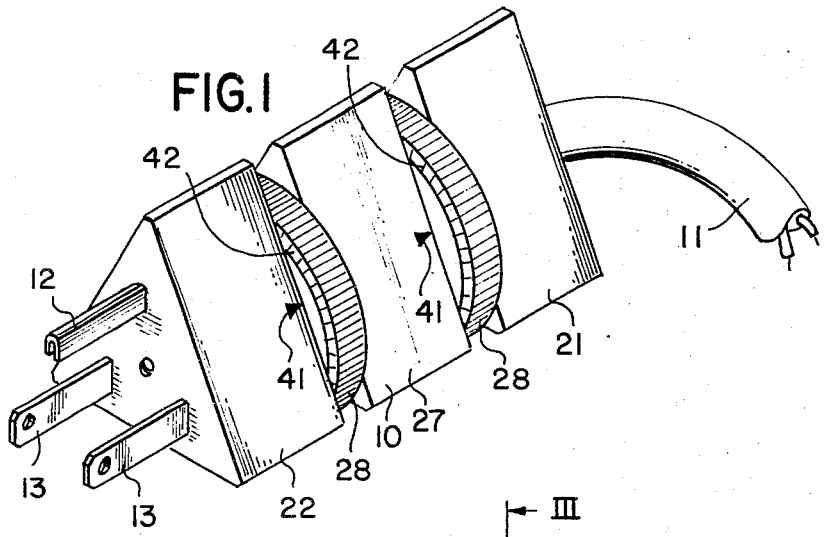
FIG. 2
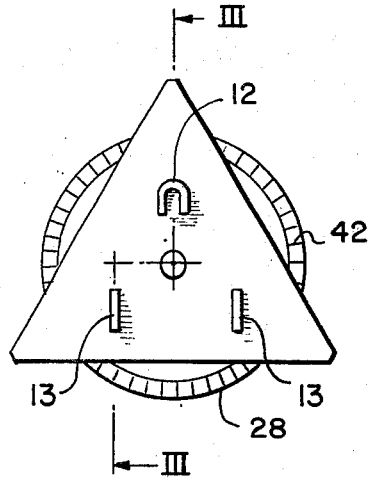
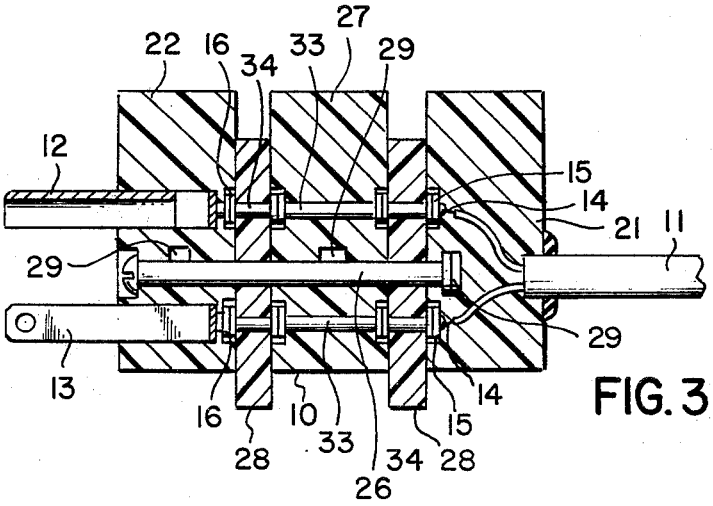
FIG. 3

SAFETY ELECTRICAL PLUG

SUMMARY OF THE INVENTION

My invention is an electrical plug adaptable for joining the conductors of an attached line cord to a socket, in which conducting elements are mounted on one or more discs rotatably mounted in the plug so that the plug conducts electricity only when the discs are rotated to a particular setting. The plug prevents unauthorized use, particularly by young children, when the discs are rotated off the particular setting.

BRIEF DESCRIPTION OF THE DRAWINGS

The objects and features of the invention may be understood with reference to the following detailed description of an illustrative embodiment of the invention, taken together with the accompanying drawings in which:

FIG. 1 is a perspective view of the invention;
FIG. 2 is a plan view of the invention; and
FIG. 3 is a sectional view of the invention.

DESCRIPTION OF THE PREFERRED EMBODIMENT

Turning now descriptively to the drawings, in which similar reference characters denote similar elements throughout the several views, FIGS. 1-3 illustrate the preferred embodiment of the invention in the form of a grounded male electrical plug 10 attached to a line cord 11 and fitted with a grounded prong 12 and two conductor prongs 13.

Alternate embodiments of the invention may be in the form of a female electrical plug, a lamp socket or a male plug fitted with only two conducting prongs 13.

The conductors 14 of line cord 11 are each attached inside the rear section 21 of plug 10 to individual contact members 15, and the prongs 12 and 13 are each attached inside the front section 22 of plug to individual contact members 16.

The plug 10 is assembled about central axial bolt 26 which fastens a fixed central section 27 and two rotatable sections 28 between the front section 22 and the rear section 21.

Front section 22, central section 27 and rear section 21 are fitted to bolt 26 by projections 29 of bolt 26 in non-rotatable engagement with each other, while each of the two rotatable sections 28 may be individually rotated at will.

Central section 27 is fitted with conductors 33 each of which connects between a conductor 16 of the forward section 22 and a conductor 15 of the rear section 21 when similar individual conductors 34 of the rotatable sections 28 are each properly aligned between the end of a conductor 33 of the midsection and the end of a conductor 15 or 16 on the adjoining fixed section 21 or 22 of the plug 10. Rotation of either or both of rotatable sections 28 from the proper alignment indicated by markings 42 on each rotatable section 28 and marking 41 on fixed sections 22, 27 or 21, serves to open the electric circuit between the prongs 12 and 13 of the plug 10 and the conductors 14 of the attached line cord.

Thus the plug 10, portable cord 11 and attached appliance (not shown) may not be used by young children unfamiliar with the marking system, when discs 28 are rotated to open the internal electrical plug circuits.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. An electrical plug fitted with a front section fixed to a rear section with two rotatable members mounted between the said fixed front and rear sections, with each rotatable member fastened so as to be individually rotatable with respect to each other and to a said fixed section which it abuts, each of said fixed sections and said rotatable members fitted with individual conducting elements, with the individual conducting elements in each rotatable member located to individually electrically connect to an individual conducting element in the abutting fixed section in a given position of rotation of each of both said rotatable members with respect to the said fixed sections, with each individual conducting element in a first rotatable member electrically connected to an individual conducting element in the second rotatable member in said given position of rotation, such that said rotatable members serve to electrically join the conducting elements of the front section individually to the conducting elements of the rear section only when each rotatable member is rotated to the said given position.

2. The combination as recited in claim 1 in which the plug is fitted with a front section fixed to a central section fixed to a rear section of the plug, with a rotatable section mounted between each side of the central section and the front or rear section.

* * * * *